United States Patent [19]

Gillmann

[11] Patent Number: 4,691,912

[45] Date of Patent: Sep. 8, 1987

[54] DEVICE FOR SEPARATING FLAT OBJECTS

[75] Inventor: Hanno Gillmann, Constance, Fed. Rep. of Germany

[73] Assignee: Licentia Patent-Verwaltungs-GmbH, Fed. Rep. of Germany

[21] Appl. No.: 751,608

[22] Filed: Jul. 2, 1985

[30] Foreign Application Priority Data

Jul. 3, 1984 [DE] Fed. Rep. of Germany ..... 3424397

[51] Int. Cl.[4] ..... B65H 3/04

[52] U.S. Cl. ..... 271/10; 271/34; 271/111; 271/265

[58] Field of Search ..... 271/34, 110, 111, 265, 271/12, 10

[56] References Cited

U.S. PATENT DOCUMENTS

| | | | |
|---|---|---|---|
| 3,981,493 | 9/1976 | Klappenecker | 271/111 X |
| 4,030,722 | 6/1977 | Irvine | 271/111 X |
| 4,077,620 | 3/1978 | Frank | 271/265 X |
| 4,190,246 | 2/1980 | Sasuga | 271/265 X |
| 4,436,298 | 3/1984 | Kleindienst | 271/111 X |

FOREIGN PATENT DOCUMENTS 2613261 10/1977 Fed. Rep. of Germany .

*Primary Examiner*—Richard A. Schacher
*Attorney, Agent, or Firm*—McGlew and Tuttle

[57] ABSTRACT

A method and apparatus is provided for separating flat objects such as mail. A control circuit compares the spacing between successive flat objects with a preferred preselected spacing and if these is a difference the control circuit changes the drive apparatus so the actual spacing between flat objects is the preferred spacing.

1 Claim, 2 Drawing Figures

DEVICE FOR SEPARATING FLAT OBJECTS

FIELD AND BACKGROUND OF THE INVENTION

The present invention relates in general to devices for singling out flat objects, such as pieces of mail, and in particular to a new and useful device for removing one flat object at a time from a stack of flat objects.

A device of this kind is known from the Werner Frank et al U.S. Pat. No. 4,077,620 which issued Mar. 7,1978 for APPARATUS FOR THE SUCCESSIVE RELEASE OF ITEMS OF MAIL FROM A STACK. That patent discloses a device for successively dispensing a singled out letter from a stack of letters which includes a drawoff member that is continuously in engagement with a foremost letter of the stack, and which revolves in a continuously controlled manner to advance letters into a pickup zone. A pair of continuously driven transport rollers are provided in the pickup zone for further advancing the letter. A first sensing device is arranged between an exit for the stack and the transport rollers.

This is followed by a second sensing device at a given distance from the first. A control circuit controls the drive of the drawoff member as a function of the signals of the sensing devices. Both sensing devices form measuring sections extending along the transport path, the output signals of which are a measure of the partial section of the respective measuring section traveled by the front edge of the letter to be dispensed or respectively by reference edge of the previously dispensed letter. The control circuit is designed so that the drive of the drawoff member sets in as soon as the partial section of the second measuring section traveled by the reference edge of the previously dispensed letter has become co-extensive with the partial section by which the letter to be dispensed protrudes into the first measuring section. Preferably the sensing devices consist of the light barriers.

In other words, the known separating or "singling" device triggers a drawoff when, by means of the sensing devices (light barriers), it is established that a given minimum distance is reached between the trailing edge of the preceding letter and the leading edge of the following letter.

This given minimum distance must in practice be given so that devices connected after the singling device, e.g. a letter sorting device, can process as many letters as possible per unit time. Trouble-free processing requires the maintenance of minimum gaps between successive letters.

Adversely affecting the actual maintenance of these minimum gaps are the different mechanical properties of the letters which are not completely alike e.g. in dimension, weight and surface roughness etc., because by the acceleration process by the triggering of their drawoff from the stack in the case of such different letters, gap enlargements as against the optimum minimum gap are the consequence. This results in a reduction of the processing performance per unit time since in the majority of cases, the letters do have different dimensions or weights.

SUMMARY OF THE INVENTION

The present invention has as its object, to bring the mean value of the actual drawoff gaps of a separating device, as close as possible to the minimum desired gap, in order thus to achieve a maximum drawoff performance. Hence the gap enlargement caused by the respective acceleration process is to be avoided.

Accordingly an object of the present invention is to provide a device for singly separating flat objects from a stack of objects, in particular a stack of letters, which comprises drawoff means for drawing flat objects one at a time from the stack, transport means spaced from said drawoff means for receiving flat objects from the drawoff means and feeding the flat objects in a feed path, drive means for driving the drawoff means, measuring means for measuring a gap between successive flat objects being conveyed by said drawoff means and transport means, and control means connected between said sensing means and said drive means for measuring the gap between successive flat objects, comparing the measured gap to a desired gap and actuating the drive means to change the gap to the desired gap.

The advantages of the invention are to be seen, accordingly, mainly in that a more uniform gap results between the flat objects to be separated, whose mean value is closer to the adjusted minimum gap. Thereby a higher mean drawoff output results without setting higher demands for following devices, e.g. sorting devices.

In the solution according to the invention, the drawoff control actuates a drawoff when a gap is detected which corresponds to the desired minimum gap minus an allowance for the acceleration path.

In further developments of the invention, the deviation of the reached gap from the desired gap is determined after a completed drawoff operation and the allowance for the acceleration path for the following drawoff start is corrected. Thereby changes in the acceleration behavior, caused by the drive system of the drawoff device and/or the singling properties of the letters or other flat objects to the singled, are corrected automatically. The system readjusts itself.

In addition, according to a development of the invention, the length of the preceding letter can be measured and depending thereon, the gap to the following letter can be controlled. This is of interest if in the following devices of the system, higher transport speeds are used (e.g. in sorting devices) and an approximately constant gap is to be obtained there regardless of letter length.

The drawoff control occurs expediently with the use of a microprocessor, which continuously polls the state of the light barriers and calculates therefrom, in its program, the desired drawoff times and triggers the drawoff member accordingly.

The same device can be used also when control for constant front edge distance is desired.

A further object of the invention is to provide a separating device which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
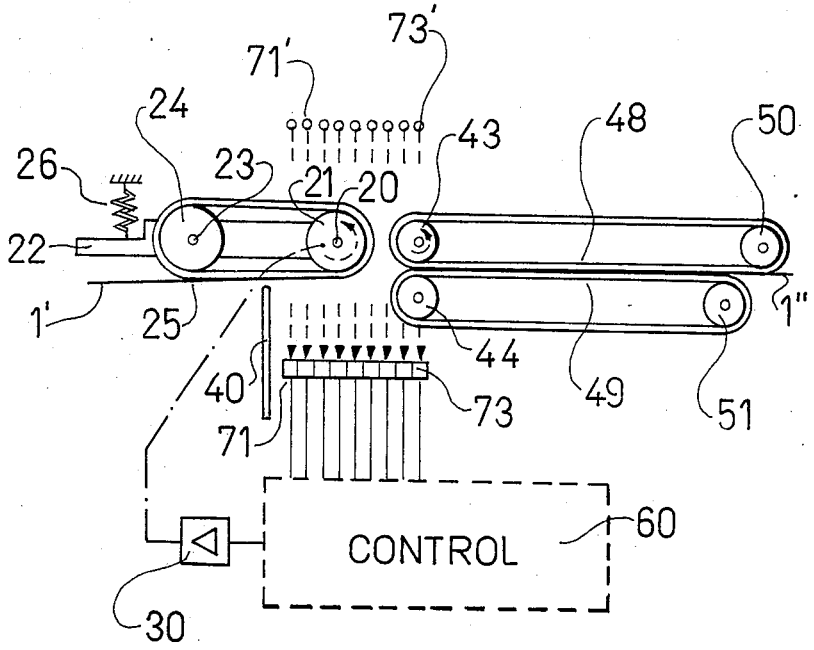
FIG. 1 is a schematic side elevational view of the inventive separating device.

Referring to the drawings in particular, the invention embodied therein comprises a separating device for separating flat objects, in particular letters, from a stack of flat objects, one at a time, and for maintaining a desired gap between successive objects fed from the stack.

As shown in FIG. 1, the inventive device includes a positionally fixed but freely rotatably shaft 20 on which is mounted and secured a roller 21. The shaft 20 serves in addition for the pivotable suspension of a rocker arm 22, which carries an axle 23 of a further roller (drawoff roller) 24. One or several drawoff belts 25 are trained around roller 21 and drawoff roller 24 and serves as a singling or separating member whose outer surface has a high coefficient of friction. The rocker arm or rocker 22 is supported by a schematically indicated spring 26 so that its respective position depends on a contact pressure it apples on a stack of letters of which the first or frontmost letter 1' is shown as it is being drawn off. The free end of rocker 22 acts on a microswitch (not shown). If the contact pressure of the stack is too low, a rest contact of the microswitch closes, whereby a gear motor (not shown) is turned on. This gear motor drives, at the stack end, a supporting wall in the direction of the drawoff roller 24 until, after reaching the position of the rocker corresponding to the intended contact pressure, the rest contact turns off again.

By a motor (not shown) which is continuously running during operation, the shaft 20 is driven in a manner controllable by means of a clutch and brake, that is, intermittently, in the direction of the dashed arrow. The clutch and brake are arranged so that in the presence of a control signal of a control circuit 60, which is explained in greater detail with reference to FIG. 2, the shaft 20 is connected with the drive, and in the absence of the control signal, braked with interruption of this connection.

A drive amplifier 30 is provided for this drive.

The edges pointing in the transport direction (leading edges) of the letters contained in the stack apply more or less closely against an abutment wall 40, which leaves a gap or stack exit free toward the drawoff belt 25 permitting the passage of the letters.

In the transport path of the letters a pair of continuously driven transport rollers 43 and 44 are arranged, by which the letters are moved on positively as soon as they have come into their pickup zone. These transport rollers serve here in addition as guide rollers of conveyor belts 48 and 49 which are trained, in the transport direction, around additional guide rollers 50 and 51. While the driven transport roller 43 is mounted fixed, the transport roller 44 is mounted flexible in known manner, e.g. on a pivotable lever, but for greater simplicity this is not shown in the drawings.

Along the transport path of the letters contiguous to the stack exit (abutment wall 40) a measuring section 71/71' is arranged. This measuring section is formed so that its output signals are a measure of the partial section of the respective measuring section traveled by the leading edge of the letter 1' to be dispensed or respectively by a reference edge (trailing edge) of the previously dispensed letter 1''.

In the shown embodiment the measuring section 71/71' is formed by seven successive light barriers, the light receivers of which bear the reference symbol 71 and the respective light sources 71'. Photo diodes or photo transistors are used as the light receivers.

In addition, a light barrier 73/73' (with light sources 73' and receiver 73) monitoring the pickup zone of the transport rollers 43 and 44 is provided.

This light barrier 73/73' is the last light barrier in the row of light barriers 71/71'. It releases the halting of the drawoff belt 25 when the leading edge of the dispensed letter has reached the conveyor belts 48,49.

Figure 2:
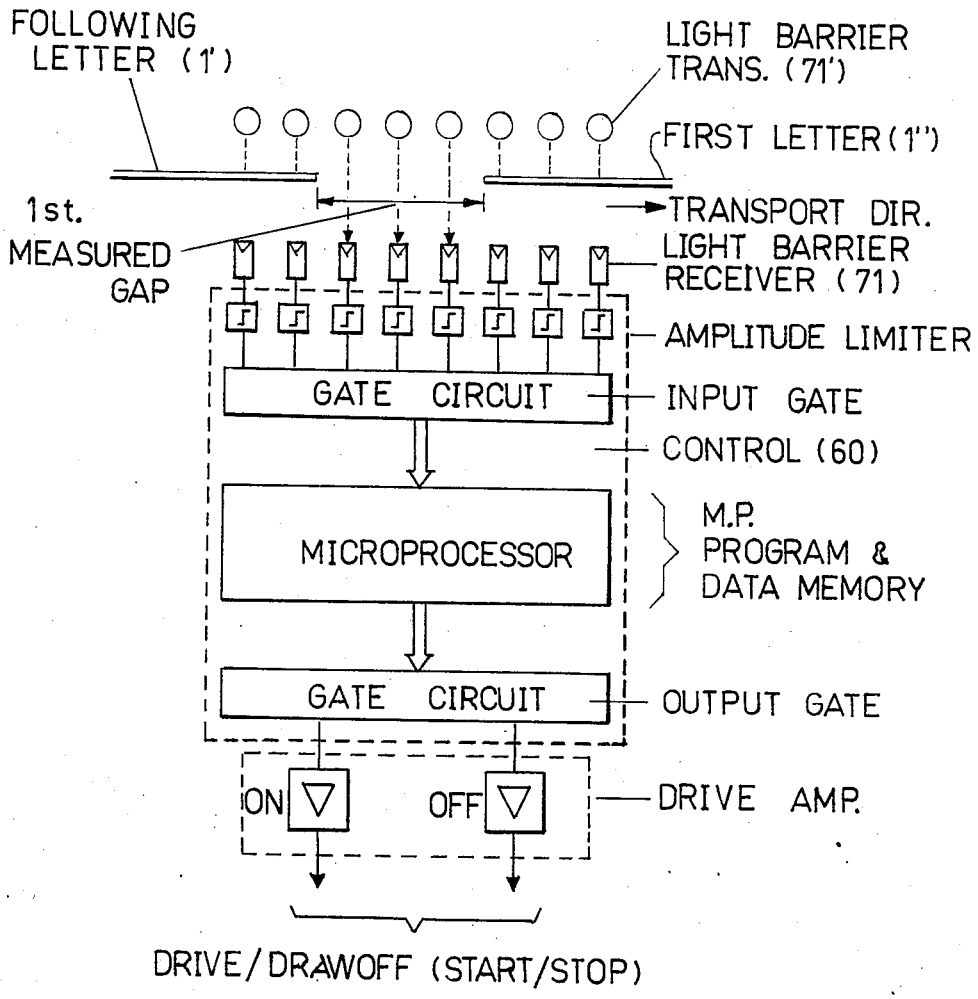
FIG. 2 is a schematic and block diagram showing details of the control equipment for the inventive separating device.

FIG. 2 schematically shows details of FIG. 1.

What is essential for the control circuit 60 is a microprocessor, which evaluates the light barrier signals and determines from bright/dark signals the respective positions of the letters 1' and 1''. By means of the signals linked in it therefrom according to the invention and its variants, from its program and data memory the control signals for the letter drawoff are obtained.

While a specific embodiment of the invention has been shown and described in detail to illustrate the application of the principles of the invention, it will be understood that the invention may be embodied otherwise without departing from such principles.

What is claimed is:

1. A device for singling and separating flat objects, in particular letters, from a stack of flat objects, comprising:

drawoff means for drawing flat objects one at a time from a stack of flat objects and feeding them onto a feed path in a feed direction;

transport means on said feed path spaced from said drawoff means for receiving flat objects from said drawoff means and feeding them on said feed path, the flat objects being fed in succession on said feed path and having an actual gap therebetween;

a plurality of sensors disposed along said feed path in an area between said drawoff means and said transport means and over at least a portion of said drawoff means for sensing the passage of flat objects and the actual gaps therebetween;

drive means connected to said drawoff means and activatable to start and stop said drawoff means to start and stop feeding of flat objects on said feed path; and control means connected to said sensors and to said drive means for measuring the actual gap between successive flat objects on said feed path and for comparing the measured actual gap with a predetermined desired gap minus an allowance for acceleration behavior of the flat objects, and for actuating said drive means at a time to change the actual gap to approximately equal the desired gap minus the allowance for acceleration behavior, the change being used by said control means to determine the acceleration behavior for a subsequent flat object on said feed path.

* * * * *